US005901481A

United States Patent [19]

Simmons et al.

[11] Patent Number: 5,901,481

[45] Date of Patent: May 11, 1999

[54] IRONING DEVICE FOR INFANT AND CHILDREN'S CLOTHING

[76] Inventors: Michael E. Simmons; Rose M. Simmons, both of 10072 Spring Sink Rd., Tallahassee, Fla. 32311

[21] Appl. No.: 08/912,079

[22] Filed: Aug. 15, 1997

[51] Int. Cl.[6] ..... D06F 75/38; D06F 75/30

[52] U.S. Cl. ..... 38/93; 38/88

[58] Field of Search ..... 38/93, 77.5, 88, 38/75, 77.83, 77.7; 219/245, 254

[56] References Cited

U.S. PATENT DOCUMENTS

| | | | |
|---|---|---|---|
| 2,552,988 | 5/1951 | Machanic | 38/93 X |
| 2,607,139 | 8/1952 | Synder et al. | 38/75 X |
| 2,746,663 | 7/1956 | Holden | 38/93 X |
| 3,577,859 | 5/1971 | Davidson . | |
| 4,219,724 | 8/1980 | Allvin | 38/93 X |
| 4,636,613 | 1/1987 | De La Morandiere et al. | 39/88 X |
| 4,856,212 | 8/1989 | Dikoff | 38/77.83 X |
| 5,408,769 | 4/1995 | Patrick | 39/88 X |

*Primary Examiner*—Ismael Izaguirre
*Attorney, Agent, or Firm*—Carnes Cona & Dixon

[57] ABSTRACT

The present invention is an iron device which is specifically designed for ironing small apparel, such as clothing for infant and/or toddlers. This device comprises a housing having an upper surface and a lower surface. A handle, for maneuvering the device, is secured to the upper surface. An electrically heated soleplate is secured to the lower surface. For easy ironing, the soleplate partially extends the length of the housing for providing for the a portion of the lower surface of the housing to be exposed.

20 Claims, 3 Drawing Sheets

IRONING DEVICE FOR INFANT AND CHILDREN'S CLOTHING

BACKGROUND OF THE INVENTION

1. Field of the Invention

The present invention relates generally to an iron and more particularly to an iron which is designed and configured specifically for infant or children's clothing.

2. Description of the Prior Art

Irons are well known in the art and are universally used for efficiently pressing and removing wrinkles in clothing. The iron has been so successful and popular that the commercial industry has fabricate irons which are engineered to perform a specific task. For instance, for the frequent traveler there exists a compact and portable iron, for the seamstress—a sewing steamer, and for those who are forgetful—an iron which turns off when not in use.

The uses for the iron are many, and each is effective. Some irons exist which perform a multiplicity of task, such as the iron disclosed in U.S. Pat. No. 3,577,859 issued to Davidson. In this patent there is disclosed a combined flatiron and integral creaser. The device comprises a downward facing lower soleplate and a second downward facing ironing surface located thereabove. A gap is located between the soleplate and second ironing surface for receiving the desired material to be creased. This device is designed to allow the user to use the soleplate for conventional ironing while the second plate will allow the user to crease the garment.

As seen, the iron is an extremely essential, advantageous, and valuable tool which has been welcomed in almost every home in the United States. However, previous efforts do not provide the benefits intended with the present invention, such as providing an iron which can successfully press infant or children's clothing. Additionally, prior techniques do not suggest the present inventive combination of component elements as disclosed and claimed herein. The present invention achieves its intended purposes, objectives and advantages over the prior art device through a new, useful and unobvious combination of component elements, which are simple to use, with the utilization of a minimum number of functioning parts, at a reasonable cost to manufacture, assemble, test and by employing only readily available material.

SUMMARY OF THE INVENTION

The present invention provides an iron device specifically designed for ironing and pressing small articles of clothing, such as infant or toddler's apparel. As such, this iron device of the present invention is compact in size, yet versatile in utility for providing a wide variety of heat settings for rendering proper pressing of the desired fabric.

Since the iron device of the present inventions is specifically designed for use with infant or children's clothing, it is assembled on a much smaller scale in comparison to conventional irons utilized for adult clothing. The total length of the iron will be approximately four to ten inches (10 cm–20 cm) and will have a total width of approximately two to five inches.

The iron device of the present invention includes a housing having an upper surface, a lower surface, a front portion and a rear portion. The lower portion of the iron device includes a substantially triangular shape, wherein the front portion includes the tip or point of the triangle and the rear portion includes a flat and straight edge of the triangle.

Attached to the lower surface, at the front portion, is a scratch resistant sole plate. This sole plate partially extends across the lower surface of the housing to provide for the rear portion of the lower surface to be exposed. This partial coverage provides a sole plate which will successfully and efficiently contact and press the desired material for pressing. The sole plate, like the lower surface of the iron includes a substantially triangular shape, wherein the front of the sole plate includes a tip or point. This tip or point will consequently aid in the pressing of the clothing by allowing the user to easily manipulate the device and provide the tip to extend in areas which were considered difficult previously.

For allowing proper pressing, apertures extend through the sole plate for rending steam to escape. Surrounding each aperture is a groove. This groove acts as a means for trapping air during the ironing process and will enable the sole plate to glide freely and smoothly on the fabric. Additionally, these grooves will assists in the prevention of adhesion between the sole plate and article of clothing being press. This prevention will inherently reduce the possibility of charring the particular material.

Extending outwardly from the rear portion of the housing is at least one flange. This flange acts as a rests for allowing the device to rest in an upright and vertical position. In the rest position, the sole plate will not contact any surface.

The upper surface of the housing includes a plurality of temperature setting switches. These switches are coupled to a rheostat which varies voltage for altering the temperature of the heat element. The heat element is located above and coupled to the sole plate. The activation of the rheostat will cause the sole plate to warm to a specific temperature. The rheostat can be controlled by way of a push button construction or optionally a dial button configuration.

The housing houses and maintains the electrical circuitry. This circuit is conventional and well known in the iron industry and as such includes not only the rheostat and heat element, but also a reservoir for receiving and maintaining water. A steam discharge passage means is located between the apertures of the sole plate and the reservoir. When it is desirable to obtain steam, a switch is depressed for opening the reservoir and allowing the water to flow through the steam discharge passage means to the apertures. As water flows onto the grooves it is instantly flashed into steam. The steaming process can be terminated by de-activating or closing of the switch in the reservoir.

The circuitry further includes a light source which not only aids in the pressing process, but will also act as a warning means. When the iron is on, the light source will be activated. This warning means acts as an indication that the iron is on and may be heated to a dangerously high temperature, thereby deterring individuals, especially children for accidentally handling the device, particularly the soleplate.

A handle is coupled to the upper surface of the housing. This handle provides a means for guiding and maneuvering the iron on the article of clothing. The buttons or dial, spray button, steam button and spray nozzle are located on the handle. For powering the unit, conventional means are utilized.

Accordingly, it is the object of the present invention to provide for a iron device specifically designed for use with infant and children's clothing and which will overcome the deficiencies, shortcomings, and drawbacks of prior irons and methods thereof.

Another object of the present invention is to provide a iron device which will efficiently and successfully press and iron infant and children's clothing by providing a sole plate having a universal shape that is adapted to reach and contact small and awkward shape areas, typical of infant or children's apparel.

Yet another object of the present invention is to provide an iron device for use with infant and/or children's clothing which includes setting modes which are easily accessible and includes a handle for comfortably maneuvering the iron device of the present invention.

Still a further object of the present invention, to be specifically enumerated herein, is to provide a iron device designed specifically for infant or children's clothing in accordance with the preceding objects and which will conform to conventional forms of manufacture, be of simple construction and easy to use so as to provide a device that would be economically feasible, long lasting and relatively trouble free in operation.

Although there have been many inventions related to a irons, none of the inventions are directly geared towards pressing and ironing children's apparel. The conventional irons are not become sufficiently compact for used with small sized clothing, typical of infant or children wear. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

DESCRIPTION OF THE PREFERRED EMBODIMENTS

With reference to drawings, and in particular to FIGS. 1–3 thereof, the iron device of the present invention will be described This iron device of the present invention provides an iron which is specifically designed and configured for ironing and pressing small articles of clothing, such as infant or toddler's apparel. To provide for such utility, the iron device is designed and configured to provide efficient pressing capabilities while enabling an adult to comfortably hold and utilize the present invention.

In order to provide for efficient pressing capabilities, the device is sized, structured and configured accordingly Hence, the iron device of the present invention is approximately four to eight inches in length and the widest portion of the iron will be two to five inches (5 cm–12.5 cm) in width. Preferably, the iron will be six to seven inches (15 cm–17.5 cm) in length have a width, at its widest section, of two to two and one half inches (5 cm–6.25 cm).

Figure 1:
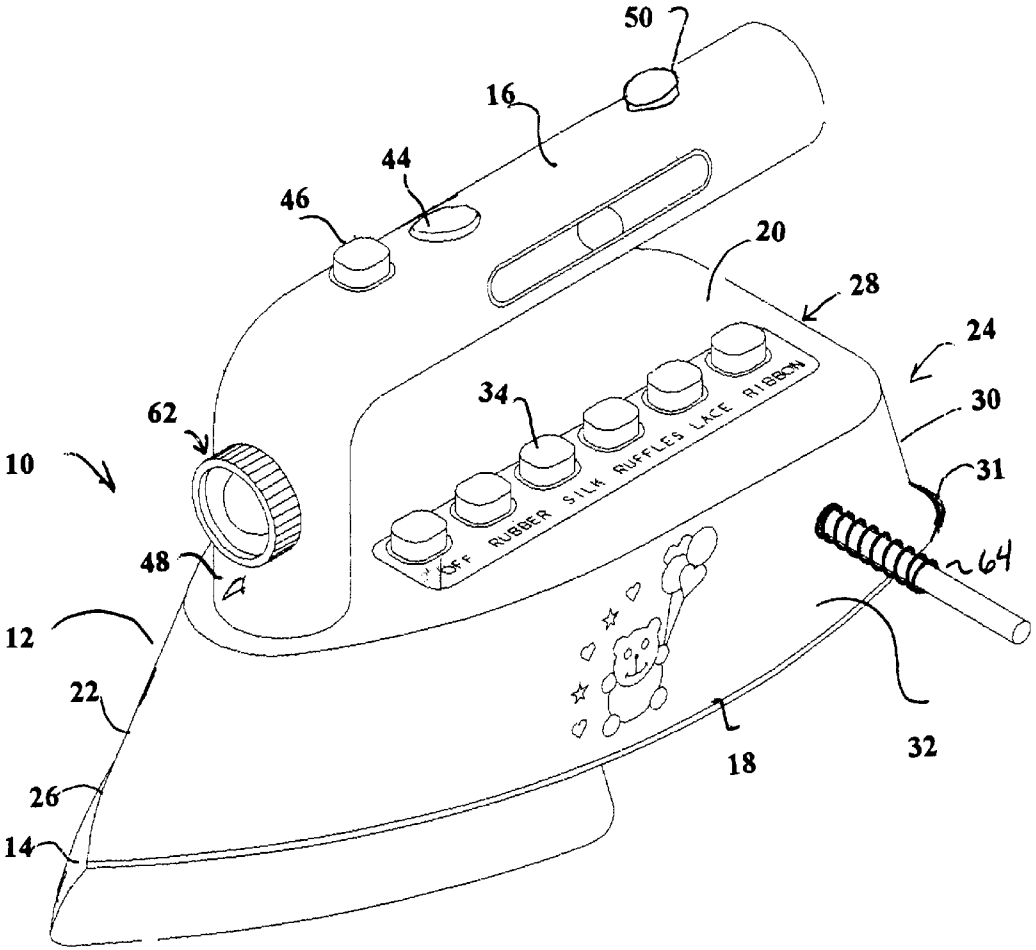
FIG. 1 is a perspective view of the iron device of the present invention which is used for pressing infant or children's clothing.
Figure 2:
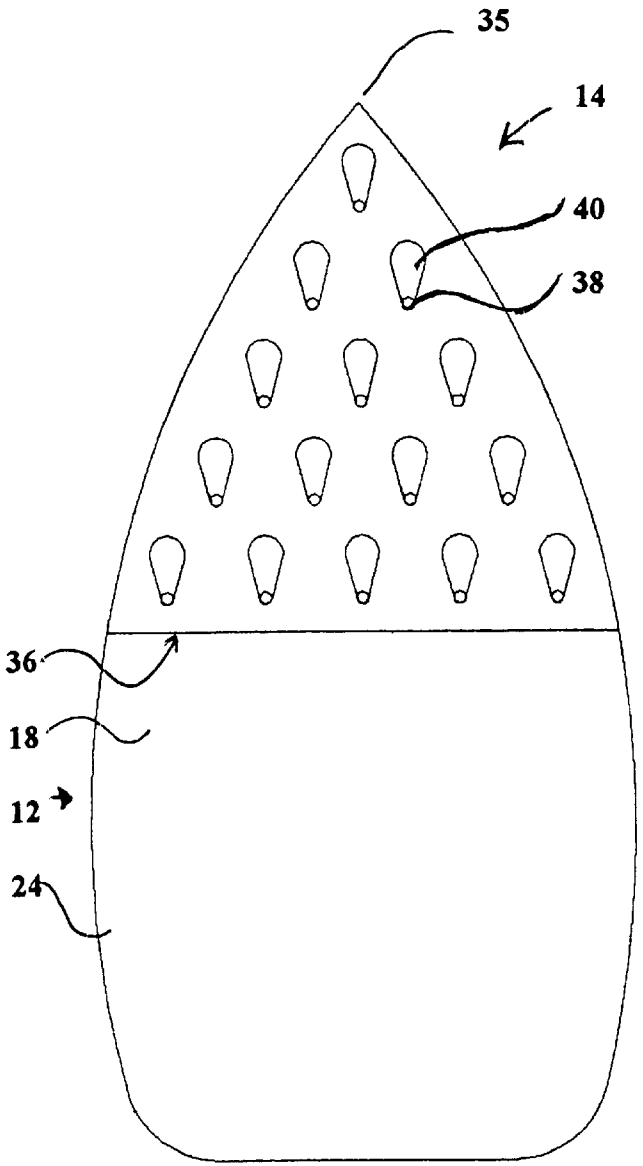
FIG. 2 is a bottom planar view of the iron device of the present invention which is used for pressing infant or children's clothing.
Figure 3:
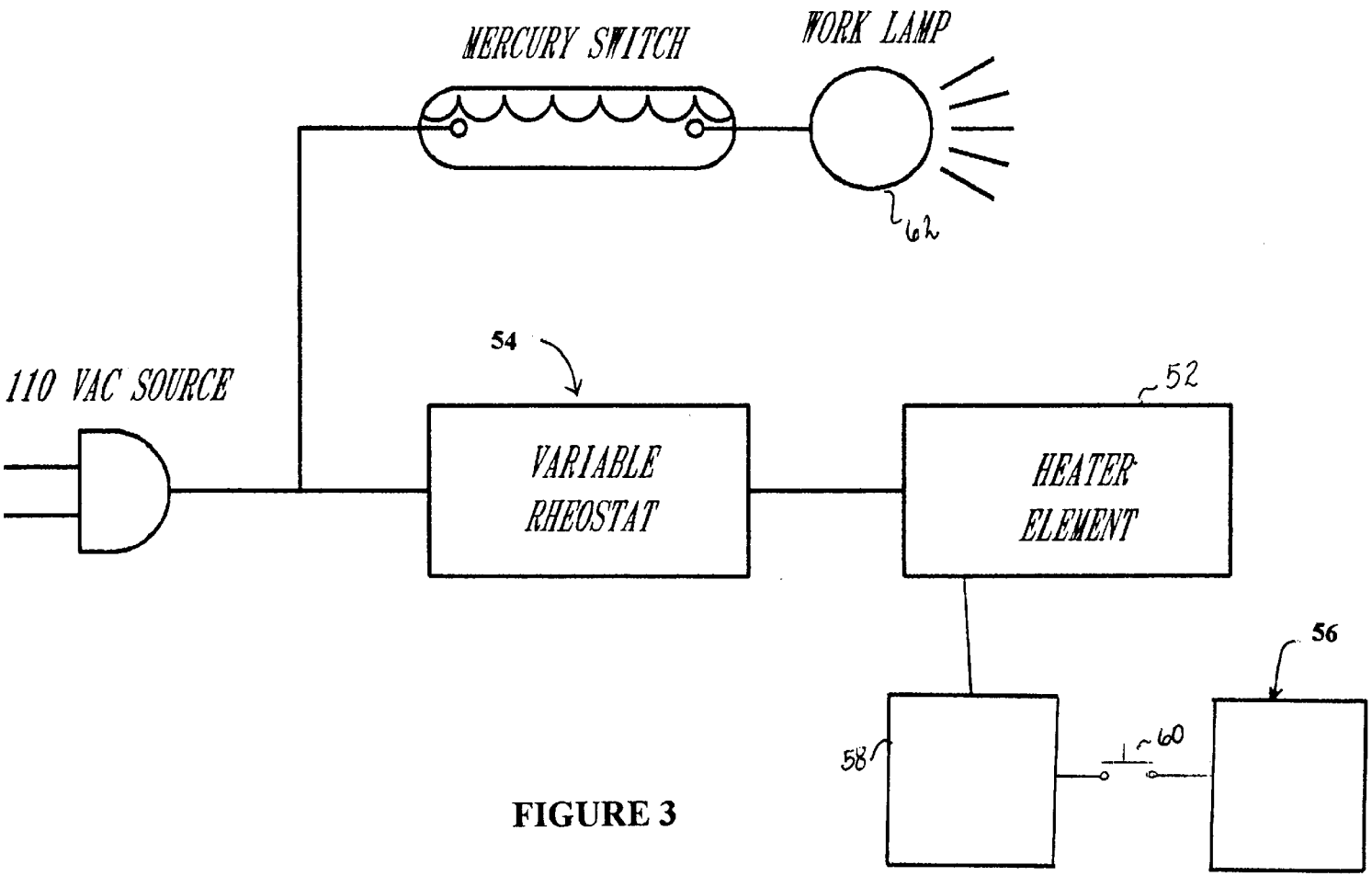
FIG. 3 is a block diagram of the circuitry used in the iron device of the present invention which is used for pressing infant or children's clothing.

As seen in the drawings, FIGS. 1–3, there is illustrated the iron device 10 of the present invention. The iron device 10 of the present invention comprises a housing 12 having a sole plate 14 attached thereto. For properly maneuvering the iron device 10, a handle 16 is secured to and located above the housing 12.

The housing 12 further includes a lower surface 18, an upper surface 20, a front portion 22 and a rear portion 24. This housing is designed and structured so as to have an overall substantially triangular shape for providing for the device to have a triangular longitudinal cross-sectional configuration Thereby, the front portion of the housing will include a tip 26 while the rear portion includes an elongated flat edge 28. Additionally, the lower surface 18 of the housing 12 is larger in size than the upper surface 20. The rear portion 24 includes a flat horizontal back wall 30 which extends from the lower surface 18 to the upper surface 20. From the opposite ends of the back wall 30 are two side walls 32 which meet to form the anterior of the iron device 10. The meeting also inherently form the point 26. Since the top surface 20 is smaller in surface area than the lower surface 18, the anterior of the iron device is sloped. The sloped configuration renders a clearance between the device and the user for allowing the user to press successfully and without visual obstruction of the device. The configuration of the housing provides a device which is designed to be user friendly. Thus, the anterior of the device will be smaller in width than the posterior of the device. This shape is not only aesthetically pleasing, but also provides structural stability when the iron is not in use and is being stored in an upright position. The upright position will provide for the back wall of the housing to rest against a particular surface, such as a self or ironing board.

To aid in the maintenance of the vertical position, at least one flange 31 can extend outwardly from the lower surface 18 of the back wall 30. This will provide for the flange to be a stand.

The upper surface 20 of the housing 12 includes a temperature setting means 34. The temperature setting means, illustrated in these figures as a plurality of push buttons, will cause a heat element to warm to a specific temperature. This will consequently cause the sole plate to warmed to the ideal temperature for the garment being press. It is noted that the temperature setting means 34 is not limited to the push button construction, as illustrated, but can include any conventional form such as, but not limited to, a sliding mechanism or a dial button construction.

Secured to the front portion 22 of the lower surface 18 of the device is the soleplate 14. The soleplate 14 is used to press the article of clothing and as such includes a unique design and configuration As seen in the drawings, the soleplate 14 has a substantially triangular shape. This shape will allow for the iron device 10 to adequately move around the article to be press, regardless of size, shape and configuration Hence, as seen this soleplate 14 includes a front point 35 and a back end 36. The lower surface of the sole plate further includes a plurality of apertures 38. These apertures extend through the soleplate. The use of the apertures 38 offers more versatility to the iron device 10 of the present invention by allowing steam to escape. This is an option which may be desirable when pressing clothing.

Surrounding each aperture 38 is a groove 40. This groove 40 acts as a means for trapping air during the ironing process and will enable the soleplate to glide freely and smoothly on the fabric. Additionally, these grooves 40 will prevent the clothing from adhering to the sole plate, inherently reducing the possibility of charring the material. These grooves will also aid in the formation of steam. Water will escape via the apertures and once water contacts the groove, the heat will instantaneously cause it to turn to steam.

The soleplate 14, as seen in the figures, is secured to the lower surface of the housing 12, but does not extend across the entire surface, but rather partially across the lower surface of the housing. Hence, it is seen that the rear portion 24 of the housing 12 is exposed. The back end 36 of the soleplate 14 will be located in proximity to the central area of the housing 12. The unique design and configuration of the soleplate, provides a device which is ideal for use with small size clothing, such as infant or toddler's clothing. The small tip and small surface area of the iron device 10, provides a product which is easy to maneuver and direct. The placement of the soleplate to the housing is such that the rear portion is exposed. The elimination of coverage in this rear portion will eliminate and prevent any unnecessary and undesirable creases while ironing. To avoid the undesirable creases, at least one third of the length of the lower surface of the housing must be exposed. This unique structure of the soleplate 14 also enhances the viewing of the article being press. Since the soleplate is relatively small, viewing of the article being pressed is optimized. Preferably, the a soleplate will be three and one-half inches (8.75 cm) in length and have a width its widest point of two to two and one-half inches (5 cm–6.25 cm).

To aid in the maintenance of the iron device 10 of the present invention, the soleplate 12 can be coated with a conventional scratch resistant material. This will prevent damage to the iron as well as to the article of clothing which is being pressed. This coating may also prolong the life of the iron device of the present invention.

For controlling and manipulating the device 10 of the present invention, a handle 16 is coupled to the upper surface 22 of the housing 12. This handle 14 provides a means for guiding and maneuvering the iron on the article of clothing.

Conventional features, such as the temperature setting means 34, water accepting means 44, steam button 46, spray nozzle 48, self-cleaning switch 50, and activation means (illustrated in the figures on the temperature setting means 34) can be located on the handle 42, as illustrated for the water accepting means 44, steam button 46 spray nozzle 48, self-cleaning switch 50, or at a convenient location on the housing 12, such as the top surface 22, as illustrated for the temperature setting means 34.

The housings 12 is hollow for encasing and maintaining the electrical circuitry for activating and controlling the functions of the iron device 10 of the present invention. The circuitry is illustrated in further detail in FIG. 3 and is shown in a block diagram formation. This circuitry is conventional and well known in the iron industry. A conventional heat element 52 is coupled to and located above the soleplate 14. Connected to the heat element is a rheostat 54. The rheostat is coupled to the temperature setting means 34. Adjusting the temperature setting means 34 will vary the voltage for altering the temperature of the heat element. The activation of the rheostat will cause the sole plate to warmed to a specific temperature. The activation/deactivation switch (on/off switch) can be located on the temperature setting means 34 or optionally can be a separate entity from the temperature setting means 34.

Other conventional features can be located on the iron device 10 of the present invention. Practical features includes the ability to apply steam or water on the article to be pressed. In order to achieve these options, the circuitry would include a water reservoir 56. Water can be placed in the reservoir 56 by the water accepting means which is an opening located exteriorly on the housing or handle. A steam discharge passage means 58 is located between the apertures of the soleplate and the reservoir. When it is desirable to obtain steam, a switch/valve 60 is between the water reservoir and the steam discharge passage means. Once this switch/valve is depressed, the valve is in an opened position and allows the water to flow through the steam discharge passage means to the apertures. As water flows onto the grooves it is instantly flashed into steam. The steaming process can be terminated by de-activating or closing of the switch in the reservoir. A conventional mechanism can be utilized for spraying water onto the article to be pressed.

The circuitry further includes a light source 62 which not only aids in the pressing process, but will also act as a warning means. When the iron is on, the light source will be activated. This warning means acts as an indication that the iron is on and may be heated to a dangerously high temperature, thereby deterring individuals, especially children from accidentally handling the device, particularly the soleplate.

Optionally, as illustrated in FIG. 3, for conserving energy, this light-can be configured so as to switch off when the iron is not in use. Hence, a mercury switch, coupled to the light source, can be provided for disabling current to the light source for deactivating its usage when the iron is in a vertical position.

The rheostat will allow for varied temperatures so as to provide an iron device which is well suited for pressing a multiplicity of materials, including, but not limited to: sheer fabrics, acetates acrylics; lightweight fabrics, silk, satin, rayon, nylon; medium weight fabrics, polyesters; permanent press, cotton blends; wool; cotton; line; rubber/leather; or the like.

For powering the unit, conventional means are utilized. As illustrated in the drawings, a cord 64, having tangle free characteristics can be utilized. Optionally the device can be solar powered or operated by way of batteries.

While the invention has been particularly shown and described with reference to an embodiment thereof, it will be understood by those skilled in the art that various changes in form and detail may be made without departing from the spirit and scope of the invention.

We claim:

1. An iron device comprising:

a housing having a top surface and a lower surface;

a soleplate is secured to said lower surface of said housing;

said soleplate partially covers a portion of said lower surface of said housing;

said housing includes a length and at least ⅓ of said length of said lower surface of said housing is exposed for providing said soleplate to be at most ⅔ said length of said lower surface of said iron;

said housing is approximately five to eight inches in length or 12.5 cm to 20 cm in length and said housing is approximately two to four inches in width or 5 cm to 10 cm in width; and a heat element is encased in said housing for heating said soleplate.

2. An iron device as in claim 1 wherein said soleplate includes a triangular shape.

3. An iron device as in claim 2 wherein said soleplate is coated with a scratch resistant material.

4. An iron device as in claim 1 wherein said housing and said soleplate have a triangular configuration.

5. An iron device as in claim 1 further comprising a handle and said handle is secured to said top surface of said housing.

6. An iron device as in claim 1 wherein said soleplate includes a plurality of apertures, said housing internally encases a reservoir for water, a steam discharge passage means is located and coupled between said apertures of said soleplate and said reservoir for allowing steam to escape via said apertures.

7. An iron device as in claim 6 wherein a groove surrounds each aperture.

8. An iron device as in claim 1 wherein a rheostat is coupled to said heat element for altering the temperature of said heat element.

9. An iron device as in claim 1 wherein said housing further includes a front portion and a rear portion, at least one stand extends outwardly from said rear portion for providing for a flange to act as a stand when in an upright and vertical position.

10. An iron device as in claim 6 wherein a spray means is exteriorly located and is coupled to said water reservoir enabling the disbursement of water when desirable.

11. An iron device as in claim 1 wherein said housing internally encases a reservoir for water and a spray means is exteriorly located and is coupled to said water reservoir for enabling the disbursement of water when desirable.

12. An iron device as in claim 1 wherein a light source is exteriorly located for providing additional visual means for a user.

13. An iron device as in claim 1 wherein a mercury switch is coupled to said light source for deactivating said light source when said iron device is in a vertical position and not in use.

14. An iron device as in claim 2 further comprising a handle and said handle is secured to said top surface of said housing.

15. An iron device as in claim 14 wherein said soleplate includes a plurality of apertures, said housing internally encases a reservoir for water, a steam discharge passage means is located and coupled between said apertures of said soleplate and said reservoir for allowing steam to escape via said apertures.

16. An iron device as in claim 15 wherein a groove surrounds each aperture.

17. An iron device as in claim 16 wherein a rheostat is coupled to said heat element for altering the temperature of said heat element.

18. An iron device as in claim 1 wherein said soleplate is approximately three to four inches in length or 7.5 cm to 10 cm in length, and said soleplate is approximately two to three inches in width or five cm to 7.5 cm in width.

19. An iron device as in claim 17 wherein a light source is exteriorly located for providing additional visual means for a user.

20. An iron device as in claim 17 wherein said soleplate is approximately three to four inches in length, or 7.5 cm to 10 cm in length, and said soleplate is approximately two to three inches in width or five cm to 7.5 cm in width.

* * * * *